US007112032B2

(12) United States Patent
Gokita

(10) Patent No.: US 7,112,032 B2
(45) Date of Patent: Sep. 26, 2006

(54) SELF-PROPELLED WORKING MACHINE

(75) Inventor: Osamu Gokita, Chiyoda-machi (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 10/518,509

(22) PCT Filed: Dec. 18, 2003

(86) PCT No.: PCT/JP03/16269

§ 371 (c)(1),
(2), (4) Date: Dec. 21, 2004

(87) PCT Pub. No.: WO2004/058625

PCT Pub. Date: Jul. 15, 2004

(65) Prior Publication Data

US 2005/0254931 A1 Nov. 17, 2005

(30) Foreign Application Priority Data

Dec. 25, 2002 (JP) ..... 2002-374838
Jan. 20, 2003 (JP) ..... 2003-011355

(51) Int. Cl.
*B66C 23/00* (2006.01)

(52) U.S. Cl. ..... 414/680; 37/468; 414/723

(58) Field of Classification Search ..... 414/680, 414/723, 785, 787, 685, 687; 37/468; 52/118; 212/349, 350
See application file for complete search history.

(56) References Cited

U.S. PATENT DOCUMENTS 4,545,720 A * 10/1985 Cochran et al. ..... 414/723

FOREIGN PATENT DOCUMENTS

| | | |
|---|---|---|
| JP | 3-501115 | 3/1991 |
| JP | 2000-128495 | 5/2000 |
| JP | 2001-82414 | 3/2001 |
| WO | WO89/00972 | 2/1989 |

* cited by examiner

*Primary Examiner*—Donald Underwood
(74) *Attorney, Agent, or Firm*—Mattingly, Stanger, Malur & Brundidge, P.C.

(57) ABSTRACT

Protective projections (26D) which are provided on cylinder mounting brackets (26) of a cargo handling tool (21) are arranged to project toward a vehicle body (2) from behind the cargo handling tool (21). When the vehicle body (2) is driven in reverse direction with a boom (12) in a folded position on the side of the ground, the protective projections (26D) are collided against obstacles (A) on the ground prior to a rod (27C) of a fork cylinder (27) if the lower side (2A) of the vehicle body (2) has passed over and clear of the obstacles (A). Thus, the protective projections (26D) function to protect the fork cylinder rod (27C) of the fork cylinder (27) against direct collision against obstacles (A) on the ground.

7 Claims, 14 Drawing Sheets

SELF-PROPELLED WORKING MACHINE

TECHNICAL FIELD

This invention relates to an automotive working machine, for example, which is provided with an automotive vehicle like a lift truck.

BACKGROUND ART

Generally, lift trucks are well known as an automotive working machine which is resorted to freight shipping (cargo handling) jobs from ground to higher position. The lift trucks of this sort are largely constituted by an automotive vehicle body provided of front and rear wheels, a boom liftably provided on the vehicle body for derricking motions, a working tool like a cargo handling tool rotatably supported at a fore end of the boom, and a tool operating cylinder located between the cargo handling tool and the boom for turning the cargo handling tool in upward and downward directions relative to the boom (e.g., as known from Japanese Patent 2,559,831 and International Publication WO 89/00972).

In the case of a lift truck of this sort, the boom is lowered into a flatly folded position on the side of the ground at the time of loading freight goods onto a fork of the cargo handling tool, and then turned upward to lift and transfer the freight goods to a higher level from the ground. At this time, the tool operating cylinder which is provided between the boom and the working tool functions to turn the cargo handling tool according to the elevation angle of the boom to maintain the fork of the cargo handling tool constantly in a horizontal posture for transferring the freight goods in a stabilized state.

By the way, the tool operating cylinder which is used on the above-described lift truck is normally constituted by a tube which is attached to the boom on the side of its bottom end, a piston which is slidably fitted in the tube, and a rod which is attached to the piston at its base end and connected to a cargo handling tool at its fore end which is projected out of the tube. When the boom is lowered into a flatly folded position on the side of the ground, the fore end of the tool operating cylinder is projected downward toward the ground surface from the lower side of the vehicle body.

Therefore, when the vehicle is on a rocky ground and driven in reverse direction with the boom in the flatly folded position, it is very likely for the rod of the working cylinder which is projected downward from the lower side of the vehicle body to be directly collided against a rock or similar obstacle on the ground surface even if the lower side of the vehicle has passed clear of the rock. The collision against such a rock can result in fracture of the working cylinder.

On the other hand, as to other automotive working machines by the prior art, there has been known a hydraulic excavator which is provided with an excavating bucket along with a bucket operating hydraulic cylinder, and in which a tubular or pipe-like cover is employed as a protector and arranged to enshroud a rod portion which is projected out of a tube of the hydraulic cylinder (e.g., as known from Japanese Patent Laid-Open No. 2001-82414).

The protector cover in the just-mentioned prior art is a tubular shape and larger in diameter than the hydraulic cylinder tube. One longitudinal end of the cover tube is attached to the fore end of the rod which is projected out of the hydraulic cylinder tube. Accordingly, the outer peripheral side of the hydraulic cylinder rod is constantly enclosed in the cover tube to prevent collisions of sand and soil against the hydraulic cylinder rod.

However, in the case of the prior art cover tube for a hydraulic cylinder, as mentioned above, one longitudinal end of the cover tube is attached to the fore end of the hydraulic cylinder rod. Therefore, when sand and soil comes into colliding contact with the cover tube, the impacts of collision are transmitted to the hydraulic cylinder rod to cause deformations and damages to the rod.

Further, in the case of the cover tube just mentioned, the cover is formed in a tubular shape to enclose the hydraulic cylinder tube and rod from the outer peripheral side thereof. Therefore, sand and soil tend to deposit between the cover and the hydraulic cylinder rod to hamper smooth operations of the hydraulic cylinder.

DISCLOSURE OF THE INVENTION

In view of the above-mentioned problems with the prior art, it is an object of the present invention to provide an automotive working machine which is provided with a means for protecting a tool operating cylinder from collision against obstacles on the ground surface to ensure smooth operations of the cylinder over an extended period of time.

According to the present invention, in order to solve the above-mentioned problems, there is provided an automotive working machine having an automotive vehicle body provided in left and right fornt wheels and left and right rear wheels, a boom liftably mounted on the vehicle body, a working tool rotatably supported on a fore end portion of the boom, and a tool operating cylinder located between the boom and the working tool at one and the other axial end thereof to turn the working tool in upward and downward directions relative to the boom.

The automotive working machine according to the present invention is characterized by the provision of: a tool mounting member provided on the back side of the working tool, on the side of the vehicle body, and having a boom connecting portion pivotally connected to the fore end portion of the boom, along with a cylinder mounting member having a cylinder connecting portion to be pivotally connected to the other end of the tool operating cylinder; and protective projections provided on the cylinder mounting member and projected from back side of the working tool toward the vehicle body to protect the other end of the tool operating cylinder from obstacles on ground surfaces when the vehicle body is driven in reverse direction with the boom in a flatly folded position on the side of the ground.

With the arrangements just described, the protective projections which are provided on the cylinder mounting member of the working tool are brought into collision against obstacles on ground surfaces prior to the tool operating cylinder when the lower side of the vehicle body passes over and clear of the obstacles during a drive in reverse direction with the boom in the folded position on the side of the ground. Accordingly, the other end of the tool operating cylinder is prevented and protected from direct collisions against obstacles on the ground surface. Besides, since the protective projections are provided on the cylinder mounting member of the working tool, impacts of collisions are sustained by the working tool, preventing the tool operating cylinder from being damaged by impacts of collision.

According to a preferred form of the present invention, top ends of the protective projections are located at a lower level than a height of a lower side of the vehicle body from a ground surface when said boom is located a folded position on the side of the ground. In this case, when the vehicle body is driven in reverse direction with the boom folded to the ground side, the tool operating cylinder may come into collision against obstacles which are lower than the height of the lower side of the vehicle body from a ground surface. Accordingly, it suffices to set top ends of the protective projections at a level which is lower than the height of the lower side of the vehicle body from the ground surface. Namely, the tool operating cylinder can be securely protected from obstacles on the ground without using unnecessarily large protective projections.

According to another preferred form of the present invention, the protective projections are bent in an obliquely upward direction from a cylinder connecting portion of the cylinder mounting member toward the tool operating cylinder. In this case, as the working tool is turned in an upward or downward direction about the boom connecting portion of the boom mounting member, the protective projections are kept out of interference with the tool operating cylinder to ensure smooth operations of the working tool.

According to still another preferred form of the invention, the protective projections are each in the form of an arcuate projection extending toward the tool operating cylinder and bent arcuately about a boom connecting portion of the boom mounting member at the back of the working tool.

With the arrangements just described, as the tool operating cylinder is contracted to turn the working tool upward and downward directions about the boom connecting portion of the boom mounting member, the protective projections are turned arcuately toward the tool operating cylinder in such a way as to preclude possibilities of interference with the protective projections.

According to another feature of the present invention, the protective projections are formed separately from the cylinder mounting member and detachably attached to the cylinder mounting member. In this case, even if the protective projection or projections are damaged by collision against an obstacle, fresh protective projections can be attached to the cylinder mounting member in place of the damaged ones. Thus, the rod of the tool operating cylinder can be protected over an extended period of time.

According to a further feature of the present invention, the protective projections are constituted by a pair of right and left plate-like members adapted to grip the other end of the tool operating cylinder therebetween. In this case, the other end of the tool operating cylinder is gripped by a pair of plate-like protective projections, precluding deposition of sand and soil between the other end of the tool operating cylinder and the protective projections to ensure smooth operation of the tool operating cylinder.

According to another feature of the present invention, the tool operating cylinder is constituted by a tube having one axial end thereof connected to the boom, a piston slidably fitted in the tube, and a rod having one axial end thereof connected to the piston and projected out of the tube at the other axial end connected to the cylinder connecting portion of the cylinder mounting member; the protective projections being adapted to protect the other projected end of the rod.

With the arrangements just described, for example, when the vehicle body is driven in reverse direction with the boom in a folded position on the side of the ground despite existence of obstacles on the ground surface, the rod of the tool operating cylinder is prevented and protected from collision against the obstacles on the ground.

In a further preferred form of the present invention, the boom is provided with an outer boom of a hollow tubular shape being liftably connected to the vehicle body at a base end portion, and an inner boom being extensibly fitted in the outer boom and provided with a cylinder mounting member on a fore end portion thereof, and further comprises a boom cylinder being located outside the outer boom and having a base end portion thereof attached to the outer boom and a fore end portion supported on a cylinder mounting portion on the inner boom, the outer boom being provided with an opening in a fore end portion to accommodate the cylinder mounting portion in a retracted position inward of a fore end of the outer boom when the inner boom is retracted into the outer boom.

With the arrangements just described, when the inner boom is retracted into the outer boom, the cylinder mounting portion which is provided on a fore end portion of the inner boom can be accommodated in the opening which is provided in a fore end portion of the outer boom and retained in a position which is retracted behind the fore end of the outer boom. Accordingly, in addition to the protection of the tool operating cylinder by the protective projections, it becomes possible to minimize the distance between the fore end of the outer boom and the fore end of the retracted inner boom, that is to say, to minimize the length of the boom as a whole in the contracted state.

Further, in a further preferred form of the present invention, the outer boom is composed of a tubular body for accommodating the inner boom, and a box-like frame body securely attached to a fore end of the tubular body, the frame body defining therein said opening in a corresponding position relative to the cylinder mounting portion of said inner boom. In this case, when the inner boom is retracted into the outer boom, the cylinder mounting portion on the inner boom can be withdrawn into the opening of the frame body to minimize the entire length of the boom in the contracted state.

BEST MODE FOR CARRYING OUT THE INVENTION

Figure 1:
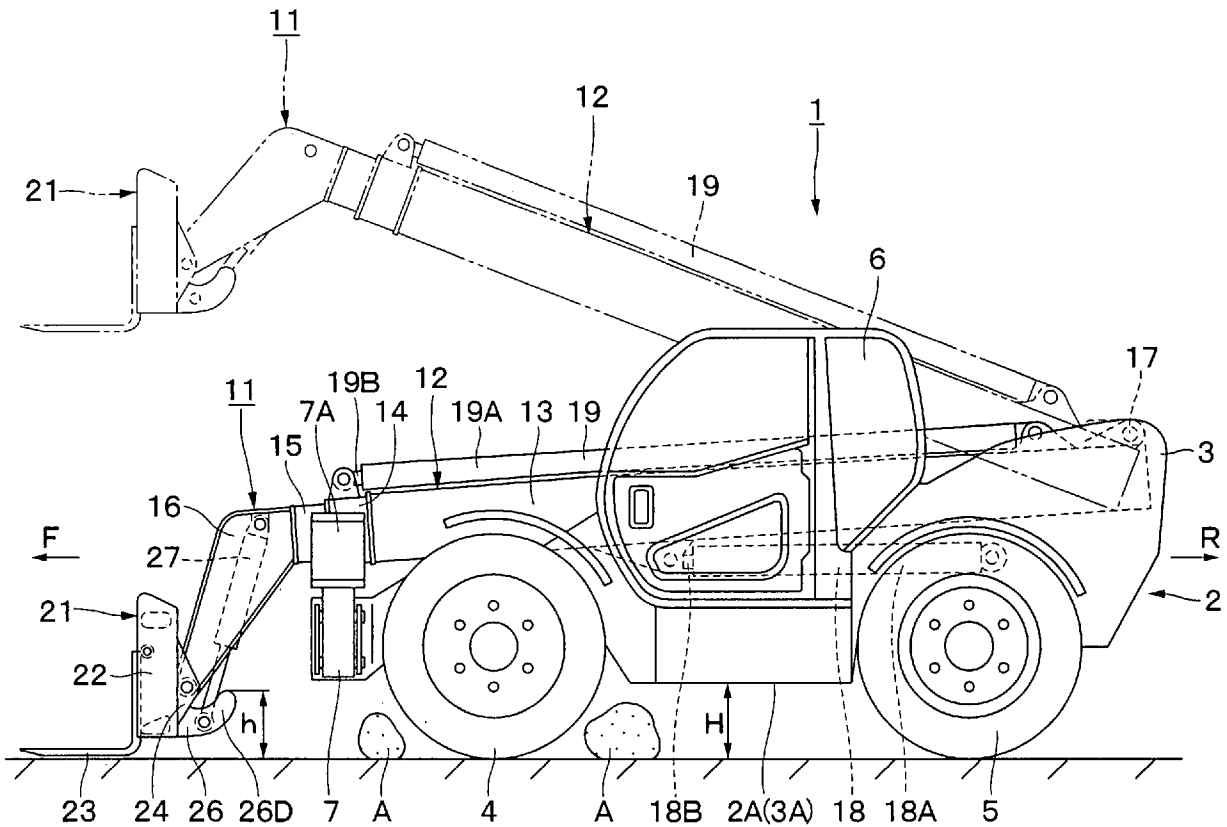
FIG. 1 is a front view of a lift truck incorporating a first embodiment of the present invention.

Hereafter, with reference to FIGS. 1 through 12, the automotive working machine according to the present invention is described more particularly by way of its preferred embodiments which are applied to a lift truck.

Referring first to FIGS. 1 to 6, there is shown a first embodiment of the present invention. In these figures, indicated at 1 is a lift truck which is largely constituted by a wheel type automotive vehicle body 2, and a working mechanism 11 which will be described in greater detail hearinafter. The lift truck 1 is used for cargo handling jobs, driving the vehicle body 2 while lifting up freight goods from the ground and transferring same to an elevated place by the working mechanism.

In this instance, the vehicle body 2 is largely constituted by a frame 3 which is formed of thick steel plates and extended toward front and rear sides of the vehicle body, drive sources such as engine, hydraulic pump, hydraulic motor and the like (none of which are shown in the drawings) which are mounted on the frame 3, and a cab 6 which will be described hereinafter. Right and left front wheels 4 (of which the left front wheel alone is shown in the drawings) are provided in a front side of the frame 3, and right and left rear wheels 5 (of which the left rear wheel alone is shown in the drawings) are provided in a rear side of the frame 3.

The right and left front wheels 4 and the right and left rear wheels 5 are rotationally driven from a hydraulic motor (not shown) simultaneously. That is to say, the vehicle body 2 is driven in a forward direction as indicated by an arrow F or in a reverse direction as indicated by an arrow R by a 4-wheel drive system. The lower side 2A of the vehicle body 2 (or the lower side 3A of the frame 3) is at a predetermined height H from the ground surface, permitting the vehicle body 2 to pass over rocks, stones or other obstacles A which are lower than the height H.

Indicated at 6 is a cab which is mounted at a longitudinally center position on the frame 3 between the front wheels 4 and the rear wheels 5 to define an operating room for the machine. Provided internally of the cab 6 are an operator's seat to be taken by an operator, a steering system for the front and rear wheels 4 and 5 and control levers (none of which are shown in the drawings) to be manipulated by an operator in controlling operations of a working mechanism 11, which will be described in greater detail hearinafter.

Further, right and left outriggers 7 (of which the left outrigger alone is shown in the drawings) are provided at the front end of the frame 3 on the front side of the front wheels 4. Footing plates 7A of these outriggers 7 are turned up away from the ground surface when the vehicle body 2 is put in travel, and for stabilization of the vehicle body 2, the footing plates 7A are set on the ground during a cargo handling operation by the working mechanism 11.

Indicated at 11 is the working mechanism which is liftably mounted on the vehicle body 2 for derricking operations. The working mechanism 11 includes a boom 12, a boom lifting cylinder 18, a first step boom cylinder 19, a cargo handling tool 21, and a fork cylinder 27, which will be described hereinafter, for lifting and transferring goods which are loaded on the cargo handling tool 21.

Denoted at 12 is a boom of the working mechanism 11. This boom 12 is of a telescopic multi-step boom, which is composed of a first step (step-1) boom 13 of a square tubular shape, a second step (step-2) boom 14 similarly of a square tubular shape telescopically fitted in the boom of the first step boom 13, and a third step (step-3) boom 15 similarly of a square tubular shape telescopically fitted in the second step boom 14, a boom head 16 fixedly provided at the fore distal end of the third step boom 15. The base end of the first step boom 13 is pivotally attached to a rear end portion of the frame 3 of the vehicle body 2 by a pin 17.

Figure 3:
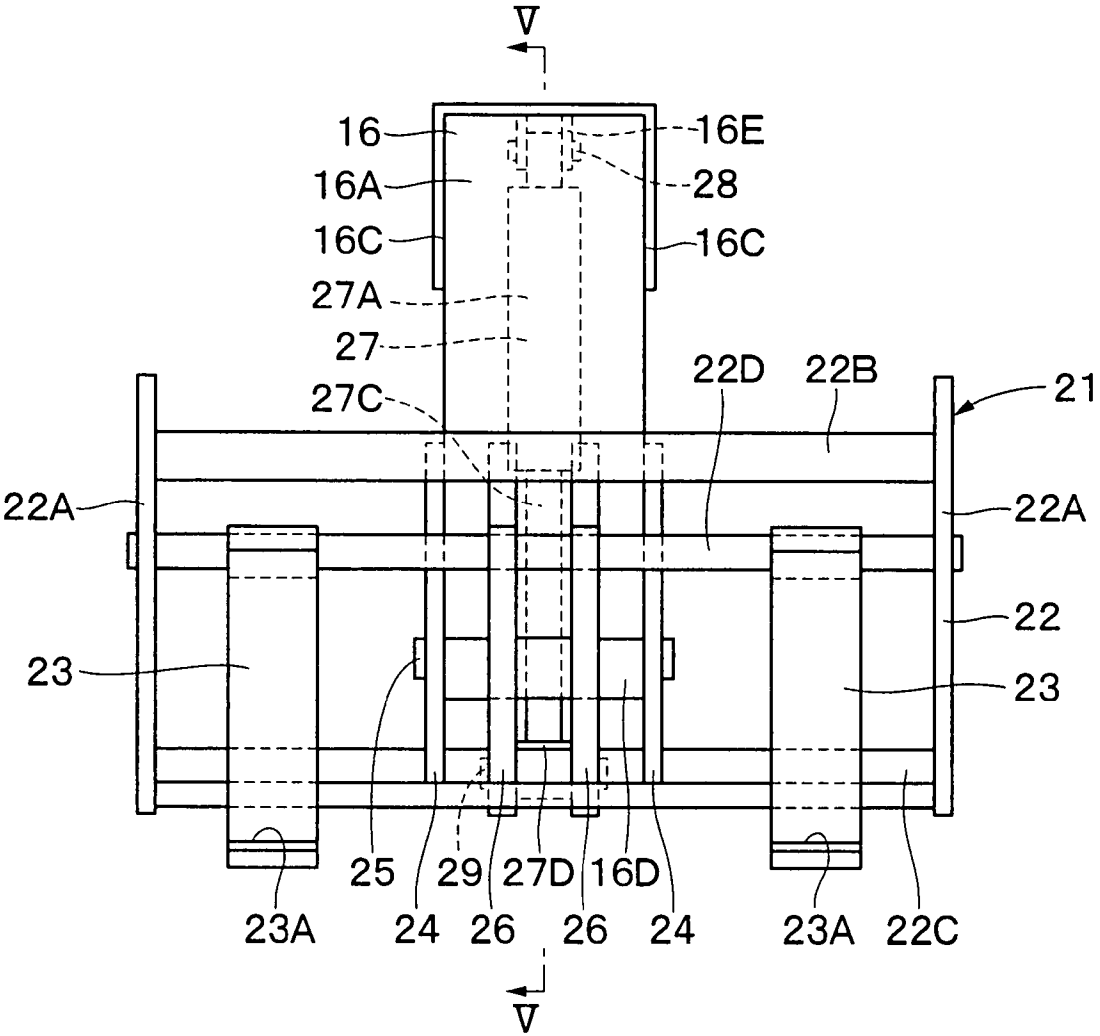
FIG. 3 is a left-hand side view of the boom, cargo handling tool and fork cylinder, taken in the direction of arrows III—III in FIG. 2.
Figure 5:
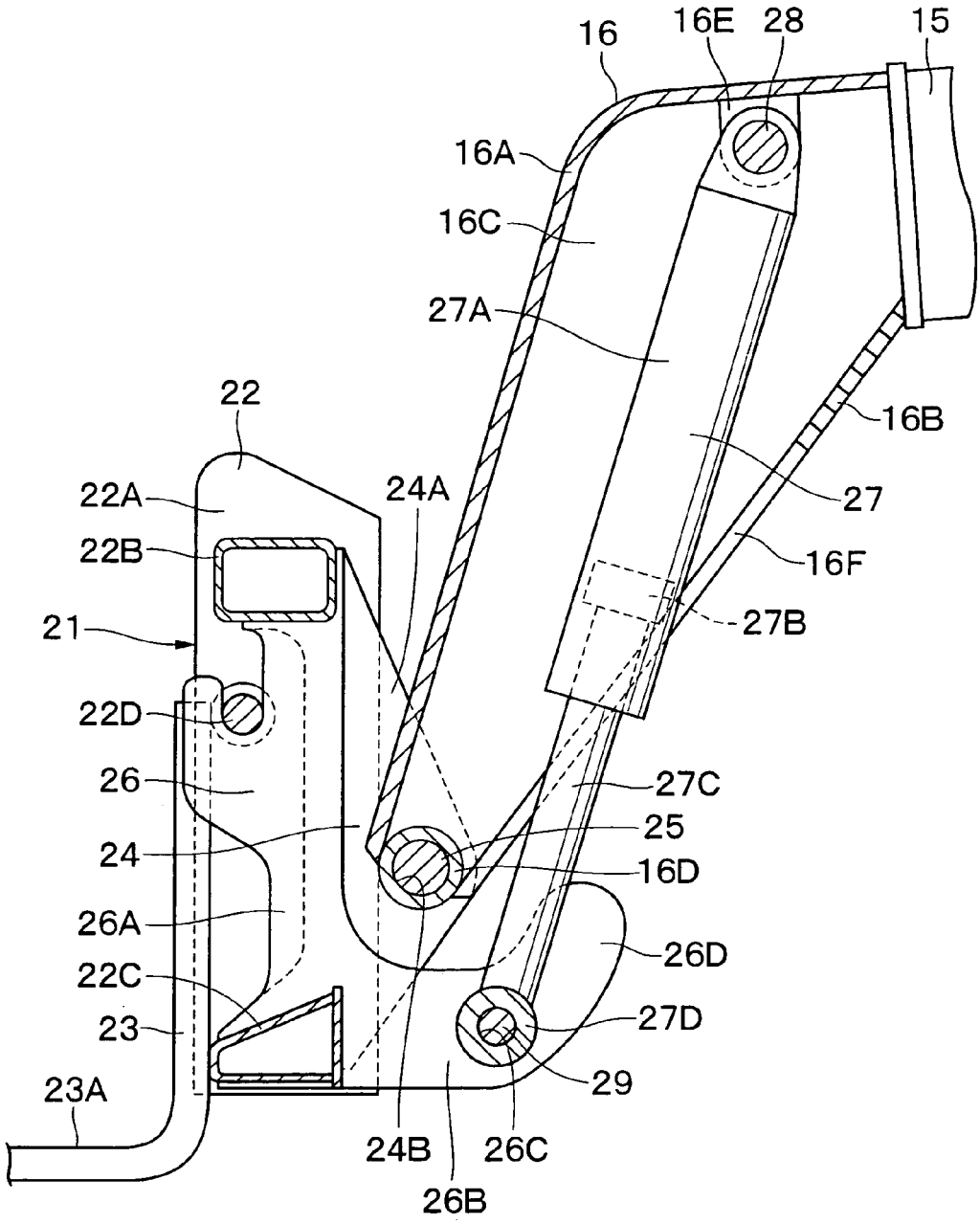
FIG. 5 is a vertical sectional view taken in the direction of arrows V—V of FIG. 3, showing on an enlarged scale the boom head, cargo handling tool, fork cylinder and protective projection in an operational phase when the rod of the fork cylinder is extended out.

In this instance, as shown in FIGS. 3 and 5, the boom head 16 is formed in a hollow box-like structure which is enclosed by front and rear plates 16A and 16B and right and left side plates 16C, and extended in an obliquely downward direction from the third step boom 15. A tubular boss portion 16D is provided at the fore end of the boom head 16 for attaching a boom mounting plate 24 of a cargo handling tool 21 which will be described in greater detail hereinafter. A bracket 16E is provided within the boom head 16 for mounting a tube 27A of a fork cylinder 27 which will be described hereinafter. An opening 16F is formed in the rear plate 16B of the boom head 16 for passing and projecting to the outside a rod 27C of the fork cylinder 27 to the outside of the boom head 16 which will be described later on.

Designated at 18 is a boom lifting cylinder which is located between the first step boom 13 and the frame 3 of the vehicle body 2. This boom lifting cylinder 18 is constituted by a tube 18A which is pivotally connected to the frame 3 through a joint pin on the bottom side thereof, a piston (not shown) which is slidably fitted in the tube 18A, and a rod 18B which is fixedly connected to the piston at its base end and pivotally connected through a joint pin to a longitudinally intermediate portion of the first step boom 13. By contracting and expanding the rod 18B relative to the tube 18A of the boom lifting cylinder 18, the boom 12 is turned about the pin 17 to take either a lowered position on the side of the ground surface (the position indicated by solid line in FIG. 1) or a raised or uplifted position away from the ground surface (the position indicated by two-dot chain line in FIG. 1).

Indicated at 19 is a first step boom cylinder which is located between the first step boom 13 and the second step boom 14. The first step boom cylinder 19 is constituted by a tube 19A which is pivotally connected on the bottom side to a rear end portion of the first step boom 13 through a joint pin, a piston (now shown) which is slidably fitted in the tube 19A, and a rod 19B which is fixedly connected at its base end to the piston and pivotally connected at the fore end to a fore end portion of the second step boom 14 through a joint pin. By contracting and expanding the rod 19B relative to the tube 19A of the first step boom cylinder 19, the second step boom 14 is contracted and expanded relative to the first step boom 13.

Further, a second step boom cylinder (not shown) is located between the second step boom 14 and the third step boom 15. In synchronism with the operation of the first step boom cylinder 19 contracting or expanding the second step boom 14 relative to the first step boom 13, the second step boom cylinder contracts or extends the third step boom 15 relative to the second step boom 14. Therefore, simultaneously with the first step boom cylinder 19, pressure oil is fed to and from the second step boom cylinder.

Figure 4:
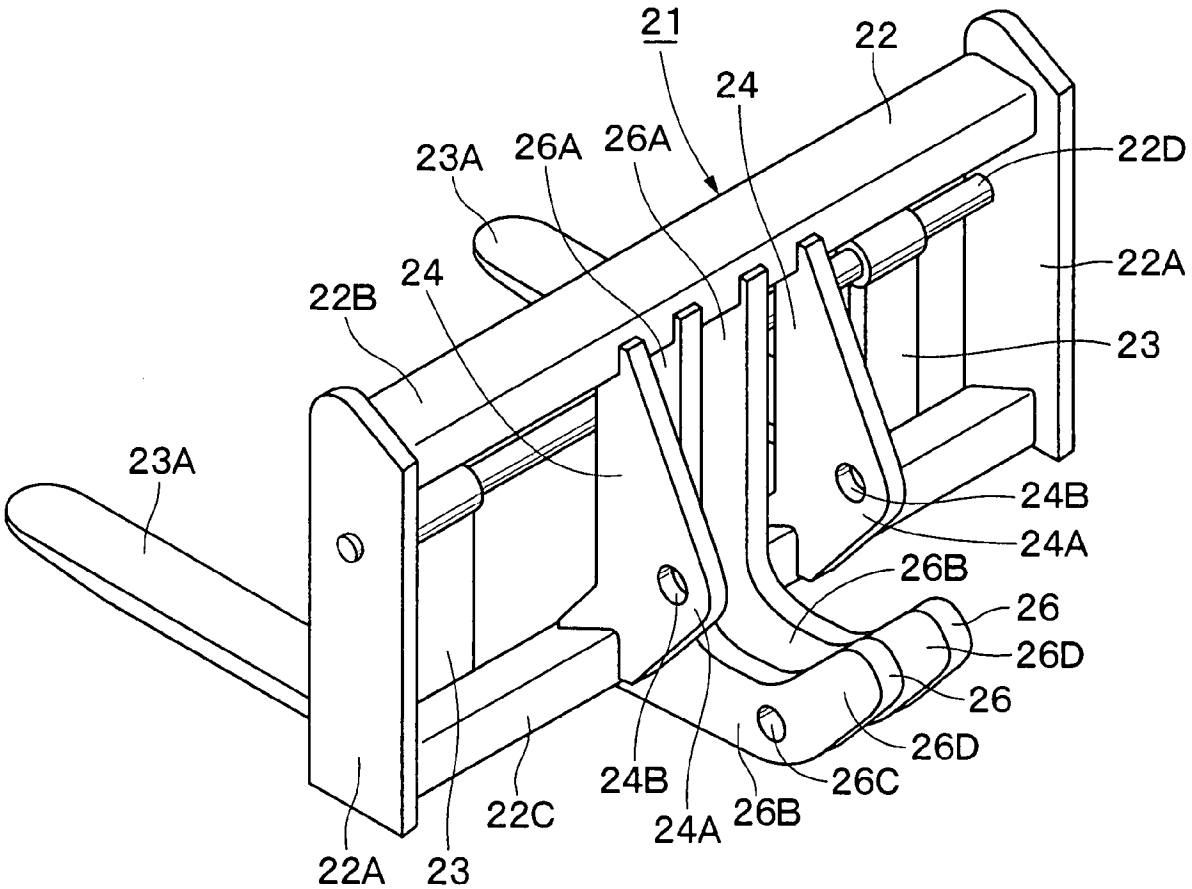
FIG. 4 is a solitary perspective view of the cargo handling tool according to the first embodiment of the present invention.

Indicated at 21 is a cargo handling tool as a working tool which is generally called "an attachment". The cargo handling tool 21 is pivotally supported at the fore end of the boom 12 (on the boom head 16) through a pin 25, for upward and downward turning movements. In this instance, as shown in FIGS. 3 to 5, the cargo handling tool 21 is constituted by a frame body 22, fork 23, boom mounting plate 24 and cylinder mounting brackets 26, which will be described hereinafter.

Indicated at 22 is a rectangular frame body constituting a base for the cargo handling tool 21. This frame body 22 is largely constituted by right and left side plates 22A which are located at the right and left sides and faced toward each other, an upper beam 22B of a rectangular shape in section bridged between the right and left side plates 22A, a lower beam 22C of a trapezoidal shape in section bridged between the right and left side plates 22A at a lower level than the upper beam 22B, and a rod-like intermediate beam 22D bridged between the right and left side plates 22A at an intermediate level between the upper and lower beams 22B and 22C.

Denoted at 23 are right and left forks which are provided on the front side of the frame body 22. Each one of the forks 23 is formed, for example, by bending a thick steel plate into the shape of letter "L". Each fork 23 is securely fixed to the intermediate beam 22D of the frame body 22 at its upper end. The lower end of each fork 23 is either abutted on or securely fixed to the lower beam 22C of the frame body 22. Further, at the lower end, each fork 23 is provided with a cargo loading surface 23A which is projected forward from the lower beam 22C of the frame body 22 to load a cargo of freight goods thereon.

Indicated at 24 are boom mounting plates as a boom mounting member, that is to say, right and left boom mounting plates which are provided on the back side of the frame body 22, in other words, on that side of the frame body 22 which faces toward the vehicle body 2. In this instance, each one of the boom mounting plates 24 is formed, for example, substantially in a triangular shape by the use of a thick steel plate, and securely fixed to the upper and lower beams 22B and 22C of the frame body 22 at its upper and lower ends, respectively. Further, each boom mounting plate 24 is provided with a rearwardly bulged portion 24A at an intermediate portion between its upper and lower ends, and a pin receiving hole 24B is provided in the bulged portion 24A to receive a pin 25 which will be described hereinafter. Through the pin 25, the cargo handling tool is pivotally connected to a fore end portion of the boom head 16.

For attaching the cargo handling tool 21 on the boom head 16, the boss portion 16D of the boom head 16 is embraced between the right and left bulged portions 24A of the right and left boom mounting plates 24, and a pin 25 is inserted into and placed in position within the boss portion 16D through the pin receiving holes 24B in the boom mounting plates 24. By so doing, the cargo handling tool 21 is pivotally connected to a fore end portion of the boom 12 for up and down turning motions about the pin 25. Thus, the pin 25 constitutes pivotal joint means along with the pin receiving holes 24B in the boom mounting plates 24 of the cargo handling tool 21 and the boss portion 16D on the part of the boom head 16.

Indicated at 26 are right and left cylinder mounting brackets which are provided on the back side of the frame body 22 between the right and left boom mounting plates 24 as a cylinder mounting member. In this instance, each cylinder mounting bracket 26 is formed substantially in the shape of letter "J" by the use of a thick steel plate, and provided with a vertical plate portion 26A which is extended in the vertical direction and securely fixed to the upper and lower beams 22B and 22C of the frame body 22 on the upper and lower sides, respectively, a foot portion 26B which is located at a lower level than the pin receiving holes 24B in the boom mounting plates 24 and extended substantially in a horizontal direction toward the vehicle body 2 from the lower end of the vertical plate portion 26A, and a pin receiving hole 26C which is formed in the foot portion 26B as a cylinder connecting portion.

In this instance, the pin receiving hole 26C is provided in a part of the foot portion 26B which is located at a lower level and at a closer position to the vehicle body 2 than the pin receiving holes 24B in the boom mounting plates 24. An end of a fork cylinder 27 is pivotally connected to the pin receiving holes 26C through a pin 29 which will be described hereinafter. Further, protective projections 26D are integrally provided at the toe ends of the respective foot portions 26B further than the pin receiving hole 26C, as described in greater detail hereinafter.

Indicated at 27 is a fork cylinder which is provided between the frame body 22 of the cargo handling tool 21 and the boom head 16 of the boom 12 as a working cylinder. By this fork cylinder 27, the cargo handling tool 21 is turned up and down relative to the boom 12. In this instance, as shown in FIG. 5, the fork cylinder 27 is constituted by a tube 27A which is located within the boom head 16, a piston 27B which is slidably fitted in the tube 27A, and a rod 27C which is attached to the piston 27B at its one axial end and projected out of the tube 27A at the other axial end.

The bottom side of the tube 27A, at one axial end of the fork cylinder 27, is pivotally supported on the brackets 16E in the boom head 16 through a pin 28. On the other hand, the rod 27C, at the other axial end of the fork cylinder 27, is projected out of the boom head 16 through the opening 16F. The rod 27C is provided with a boss portion 27D at its end portion. The boss portion 27D is interposed between the foot portion 26B of the right and left cylinder mounting brackets 26 and pivotally connected to said bracket 26 by means of a pin 29 which is inserted in the pin receiving holes 26C of the cylinder mounting brackets 26. Therefore, the rod 27C of the fork cylinder 27 is pivotally connected to the cargo handling tool 21 by the pin 29. Thus, the pin 29 constitutes a pivotal connection means between the pin receiving holes 26C in the cylinder mounting brackets 26 and the rod 27C of the fork cylinder 27.

Figure 6:
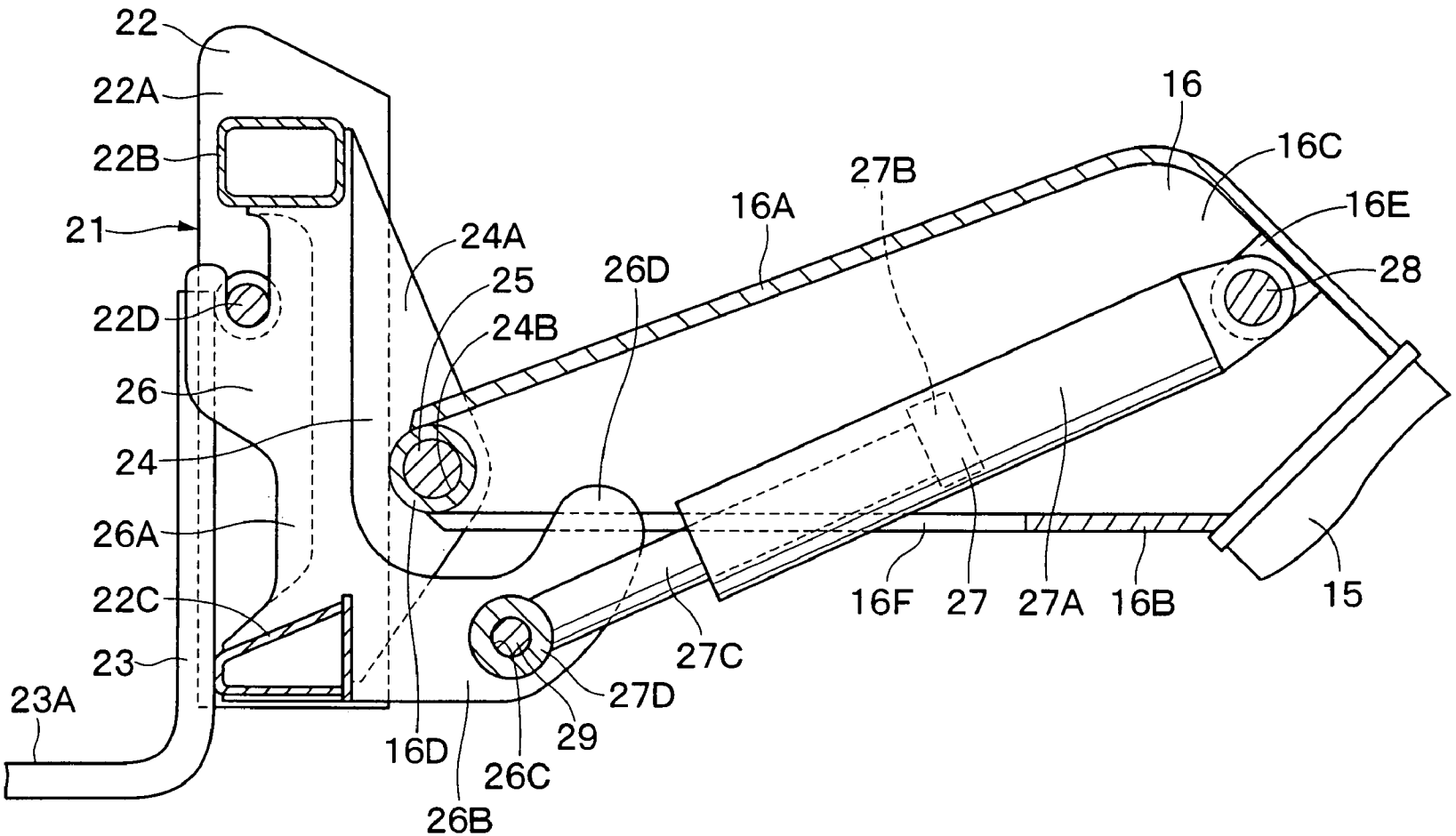
FIG. 6 is a vertical sectional view similar to FIG. 5 but showing the boom head, cargo handling tool, fork cylinder and protective projection in an operational phase when the rod of the fork cylinder is contracted.

Thus, by expanding and contracting the rod 27C of the fork cylinder 27, the cargo handling tool 21 can be turned up and down about the pin 25 relative to the boom 12 (relative to the boom head 16) as shown in FIGS. 5 and 6. As the boom 12 is elevated from the folded or lowered position, which is indicated by solid line in FIG. 1, to the lifted position indicated by two-dot chain line, the cargo handling tool 21 is turned according to an elevation angle of the boom 12 to maintain the cargo loading surfaces 23A of the forks 23 constantly in a horizontal posture for uplifting and transferring freight goods on the cargo loading surfaces 23A from a ground level to an elevated place.

Figure 2:
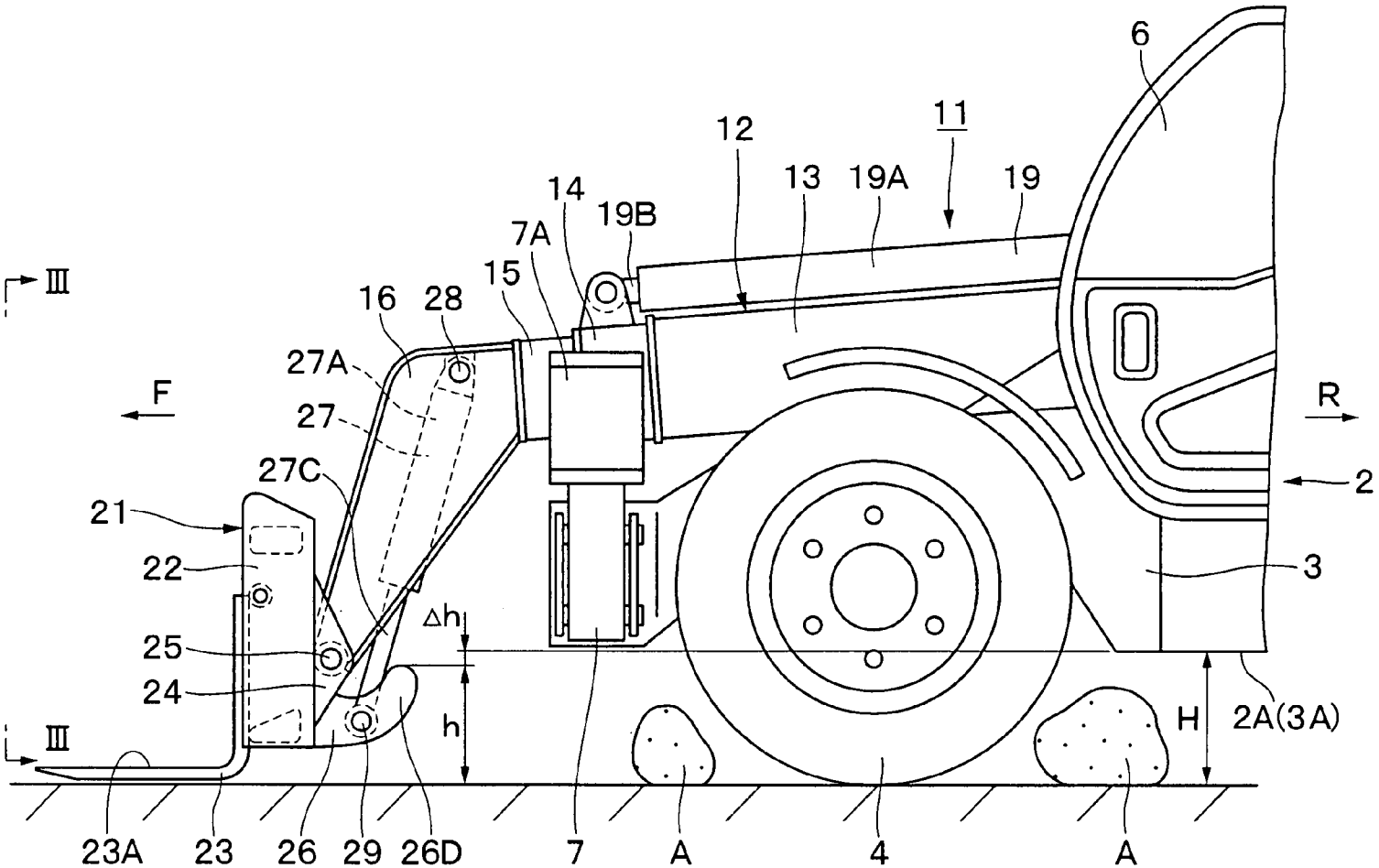
FIG. 2 is a front view showing on an enlarged scale of a boom, cargo handling tool, fork cylinder and protective projection in FIG. 1.

Indicated at 26D are protective projections which are provided at the toe ends of the right and left cylinder mounting brackets 26. These protective projections 26D are integrally formed at the fore ends of the foot portion 26B of the cylinder mounting brackets 26, which are located at a lower level than the pin-receiving holes 24B in the boom mounting plates 24. In this instance, the protective projections 26D are constituted by a pair of right and left upturned plate-like members which are arranged to grip a fore end portion of the rod 27C of the fork cylinder 27 from opposite sides. More specifically, the protective projections 26D are bent on an obliquely upward direction toward the fork cylinder 27 and projected toward the vehicle body 2 from rear side of the pin receiving holes 26C in the foot portion 26B of the cylinder mounting brackets 26. As seen in FIGS. 1 and 2, when the vehicle body 2 is driven in the reverse direction R with the boom 12 folded in the lowered position on the ground side, and is passing over obstacles A on the ground which the lower side 2A of the vehicle body 2 can clear but the rod 27C of the fork cylinder 27 cannot, the protective projections 26D are brought into collision against the obstacles A prior to the fork cylinder rod 27C to protect same.

In this connection, as shown in FIG. 2, when the boom 12 is folded in the lowered position on the side of the ground, the protective projections 26D are arranged such that the height h of the top ends of the protective projections 26D from the ground surface is lower than the height H of the lower side 2A of the vehicle body 2 by Δh. In this instance, when the vehicle body 2 is driven in the reverse direction with the boom 12 folded on the side of the ground, the obstacles A having possibilities of collision against the fork cylinder rod 27C of the fork cylinder 27 are considered to be lower than the height H of the lower side 2A of the vehicle body 2 from the ground surface. Accordingly, the protective projections 26D can be suppressed to a minimal necessary size by setting the height h of the protective projections 26D from the ground surface at a value smaller than the height H of the lower side 2A of the vehicle body 2 from the ground surface.

Further, as shown in FIG. 5, the protective projections 26D are each formed as an arcuate projection which is projected toward the fork cylinder rod 27C of the fork cylinder 27 arcuately about the pin 25 in the pin receiving holes 24B in the boom mounting plates 24 of the cargo handling tool 21. Consequently, when the rod 27C of the fork cylinder 27 is contracted into the tube 27A as shown in FIG. 6, turning upward and downward the cargo handling tool 21 about the pin 25, the protective projections 26D are moved toward the fork cylinder rod 27C by an arcuate turn about the pin 25. Thus, the protective projections 26D are arranged to preclude possibilities of interference with the tube 27A of the fork cylinder 27.

Following are features in operation of the lift truck 1 of the present embodiment which is arranged in the manner as described above.

Firstly, for a cargo handling operation by the working mechanism 11, freight goods (not shown) are put on the cargo loading surfaces 23A of the forks 23 of the cargo handling tool 21, with the boom 12 folded in the lowered position on the side of the ground as shown in FIG. 1. Then, after driving the automotive vehicle body 2 to a working site, the footing plates 7A of the outriggers 7 are set on the ground to stabilize the vehicle body 2.

In the next place, through manipulation of control levers (not shown) of the working mechanism 11 by an operator within the cab 6, pressure oil is fed to and from the boom lifting cylinder 18, the first step boom cylinder 19, the second step boom cylinder (not shown) by a hydraulic pump (not shown). By so doing, the boom 12 is raised from the folded position (indicated by solid line in FIG. 1) to the elevated position (indicated by two-dot chain line in FIG. 1 by the boom lifting cylinder 18). Further, the second step boom 14 and the third step boom 15 are extended out from the first step boom 13 of the boom 12 by the first step boom cylinder 19 and the second step boom cylinder, respectively.

At this time, in step with the operation of the boom lifting cylinder 18, the fork cylinder 27 is put in operation to turn the cargo handling tool 21 upward or downward relative to the boom head 16 according to the angle of elevation of the boom 12. As a consequence, the cargo loading surfaces 23A of the forks 23 can be maintained in a substantially horizontal posture constantly according to the elevation angle of the boom 12, permitting to lift and transfer the freight goods on the cargo loading surfaces 23A from a ground level to an elevated level in a stabilized state.

In this instance, when the boom 12 is in the folded position on the side of the ground, the fore end of the rod 27C of the fork cylinder 27 is projected downward beyond the lower side 2A of the vehicle body 2 as seen in FIGS. 1 and 2. Therefore, if in this state the vehicle body 2 is driven in the reverse direction and the lower side 2A of the vehicle body 2 past obstacles A on the ground, it is very likely for the obstacles A to come into collision against the rod 27C of the fork cylinder 27.

However, in the case of the lift truck 1 according to the present embodiment, the protective projection 26D is provided on each one of the cylinder mounting brackets 26 of the cargo handling tool 21. These protective projections 26D are provided at the toe ends of the foot portion 26B which are located at a lower level than the pin receiving holes 24B in the boom mounting plates 24, and projected toward the vehicle body 2 beyond the pin receiving holes 26C. Therefore, when the vehicle body 2 is driven in the reverse direction as described above, the protective projections 26D are collided against obstacles A on the ground prior to the rod 27C of the fork cylinder 27 after the lower side 2A of the vehicle body 2 has passed clear of the obstacles A. Thus, for protective purposes, the protective projections 26D prevent direct collisions of the fork cylinder rod 27C of the fork cylinder 27 against obstacles A on the ground and protect the fork cylinder rod 27C rightly.

In this case, since the protective projections 26D are provided on the cylinder mounting brackets 26 of the cargo handling tool 21, the impacts which result from collision of the protective projections 26D by the obstacles A can be sustained by the entire cargo handling tool 21. It follows that, in contrast to the afore-mentioned prior art construction using a cover around a cylinder rod, the protective projections 26D function to prevent the impacts of collision by the obstacles A from being directly transmitted to the fork cylinder 27, that is to say, to prevent damages to the fork cylinder 27 for the purpose of enhancing operational reliability of the fork cylinder 27.

Further, the paired protective projections 26D are arranged to embrace a fore end portion of the fork cylinder rod 27C from opposite sides. Therefore, as compared with the afore-mentioned prior art using a tubular cover which is arranged to circumvent the outer peripheral side of a rod, there is no possibility of accumulation of sand and soil between each protective projections 26D and the rod 27C. That is to say, smooth operations of the fork cylinder 27 can be guaranteed over an extended period of time.

Here, obstacles A which would collide against the fork cylinder rod 27C of the fork cylinder 27 are considered to be lower than the height H of the lower side 2A of the vehicle body 2 from the ground surface. Therefore, according to the present embodiment, the protective projections 26D are set at a height h which is smaller than the height H by Δh, precluding provision of protective projections 26D of such unnecessarily large sizes as would spread the freedom of structural designs around the protective projections 26D.

Furthermore, according to the present embodiment, each one of the protective projections 26D is in the form of an arcuate projection which is extended toward the rod 27C of the fork cylinder 27 arcuately about the pin 25 which is inserted as a joint pin in the pin receiving holes 24B in the boom mounting plates 24 of the cargo handling tool 21 and in the boss portion 16D of the boom head 16. Therefore, while the boom 12 is elevated to the uplifted position, the rod 27C of the fork cylinder 27 is contracted into the tube 27A in relation with the elevation angle of the boom 12 as shown in FIG. 6, and even when the cargo handling tool 21 is turned about the pin 25, there is no possibility of interference of the protective projection 26D with the tube 27A of the fork cylinder 27. Accordingly, despite the provision of the protective projections 26D, the cargo handling tool 21 can be smoothly turned relative to the boom head 16 to maintain the cargo loading surfaces 23A of the forks 23 constantly in a horizontal posture according to the angle of elevation of the boom 12.

Moreover, for example, when the boom 12 is in the folded position on the side of the ground (in the position shown in FIG. 2) and the rod 27C of the fork cylinder 27 is expanded to turn the cargo handling tool 21, top ends of the protective projections 26D are turned about the pin 25 and prevented from colliding against the ground surface in a secure manner.

Figure 7:
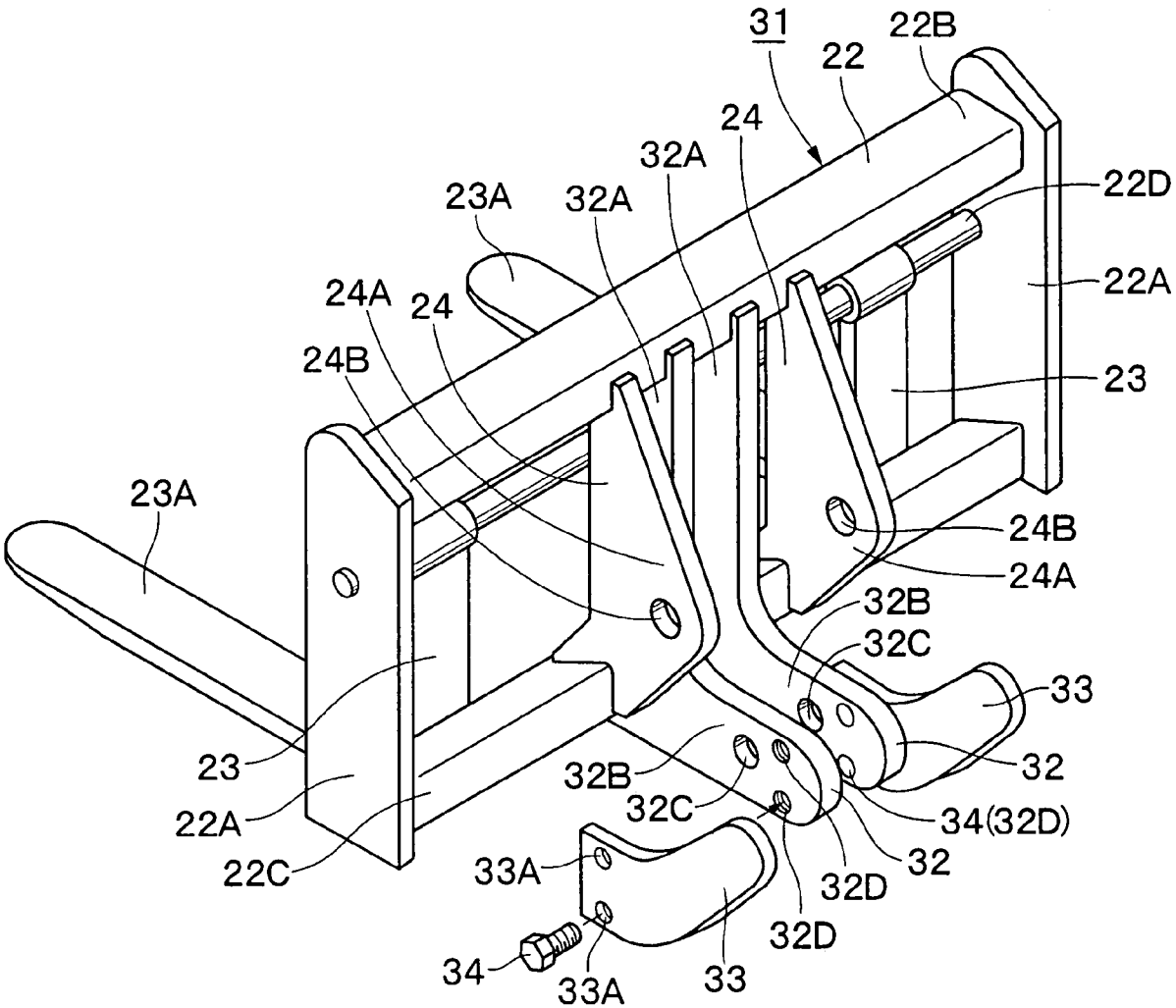
FIG. 7 is an exploded perspective view of the cargo handling tool and protective projection plate according to a second embodiment of the present invention.

Now, turning to FIG. 7, there is shown a second embodiment of the present invention. This embodiment has features in that protective projections are formed separately of a fork cylinder mounting member and detachably attached to the cylinder mounting member. In the following description of the second embodiment, those component parts which are identical with the counterparts in the foregoing first embodiment are simply designated by the same reference numerals or characters to avoid repetitions of same explanations.

In the drawings, indicated at 31 is a cargo handling tool which is adopted in the present embodiment as a working tool in place of the cargo handling tool 21 in the first embodiment. The cargo handling tool 31 is pivotally supported at the fore end of the boom 12 (the boom head 16) for upward and downward turning movements. In this instance, similarly to the counterparts in the first embodiment, the cargo handling tool 31 is constituted by a frame body 22, forks 23 and boom mounting plate 24, and cylinder mounting brackets 32 and protective projection plates 33 which will be described hereinafter.

The cargo handling tool 31 according to the second embodiment differs from the cargo handling tool 21 of the first embodiment in that cylinder mounting brackets 32 of different shape are employed in combination with separable or removable protective projection plates 33 from the cylinder mounting brackets 32.

Indicated at 32 are right and left cylinder mounting brackets as the cylinder mounting member which are provided on the back side of the frame body 22 between the right and left boom mounting plates 24. These cylinder mounting brackets 32 are adopted by the second embodiment in place of the cylinder mounting brackets 26 in the first embodiment. In this instance, each one of the cylinder mounting brackets 32 is formed substantially in the shape of letter "L" by the use of a thick steel plate, and provided with a vertical plate section 32A which is securely fixed to the upper and lower beams 22B and 22C of the frame body 22 at its upper and lower end portions, respectively, a foot section 32B which is located at a lower level than the pin receiving holes 24B in the boom mounting plates 24 and projected substantially horizontally toward the vehicle body 2 from the lower end of the vertical plate section 32A, and a pin receiving hole 32C which is provided in each one the foot sections 32B as a cylinder connecting portion.

In this instance, the pin receiving holes 32C in the foot sections 32B are located at a lower level and at a position closer to the vehicle body 2 than the pin receiving holes 24B in the boom mounting plates 24. The other end of the fork cylinder 27 is pivotally connected to the pin receiving holes 32C through a pin 29. Further, a couple of female screws holes 32D are provided on the fore side of the pin receiving hole 32C in the foot section 32B to receive bolts 34 which will be described hereinafter.

Indicated at 33 are protective projection plates which are provided separately of the cylinder mounting brackets 32. These protective projection plates 33 are each formed in an arcuate shape to extend an obliquely upward direction toward the vehicle body 2 when attached to a toe portion of the foot section 32B of the cylinder mounting bracket 32 in overlapped relation with the latter. A couple of bolt holes 33A are formed in a base end portion of each protective projection plate 33 at corresponding positions relative to the female screw holes 32D of the cylinder mounting bracket 32.

By threading bolts 34 into the female screw holes 32D in the cylinder mounting brackets 32 through the bolt holes 33A, the protective projection plates 33 are securely fixed on the foot sections 32B of the cylinder mounting brackets 32.

Thus, for example, even when the rod 27C (the boss portion 27D) of the fork cylinder 27 is connected to the cylinder mounting brackets 32 by the pin 29, the protective projection plates 33 alone can be attached to or detached from the cylinder mounting brackets 32 simply by tightening or loosening the bolts 34.

Being arranged in the manner as described above, the lift truck according to the second embodiment provided the cargo handling tool 31 has no differences from the foregoing first embodiment in a fundamental operating mechanism.

However, in the case of the second embodiment, the protective projection plates 33 which are provided separately of the cylinder mounting brackets 32 are detachably attached on the latter by the use of bolts 34.

Therefore, in the event that the protective projection plate 33 is damaged as a result of collision against an obstacle A, the damaged protective projection plate 33 on the cylinder mounting bracket 32 can be easily replaced by a fresh one. Accordingly, it becomes possible to protect the rod 27C of the fork cylinder 27 over a prolonged period of time and to enhance the operational reliability of the fork cylinder 27 all the more.

Now, turn to FIGS. 8 to 11, there is shown a third embodiment of the present invention. This third embodiment has feature in that, in addition to a protective projection which is provided on a cylinder mounting member of a working tool, an opening is provided at a fore end of an outer boom to accommodate a cylinder mounting portion which is provided at a fore end of an inner boom. In the following description of the third embodiment, those component parts which are identical with the counterparts in the foregoing first embodiment are simply designated by the same reference numerals or characters to avoid repetitions of same explanations.

In the drawings, indicated at 41 is a working mechanism which is adopted by the third embodiment in place of the working mechanism 11 of the first embodiment. The working mechanism 41 is constituted by a boom 42, a boom lifting cylinder 18, a first step boom cylinder 19, a second step boom cylinder 52, a cargo handling tool 21 and a fork cylinder 27.

Indicated at 42 is a telescopic boom which is constituted by a first step boom 43, a second step boom 49, a third step boom 57, a boom head 16 etc.

Denoted at 43 is the first step boom as an outer boom, and the first step boom 43 is constituted by a square tubular body 44 which is extended toward front and rear direction and adapted to accommodate the second step boom 49 therein, and a frame body 45 which is securely fixed to the fore end of the square tubular body 44.

Figure 9:
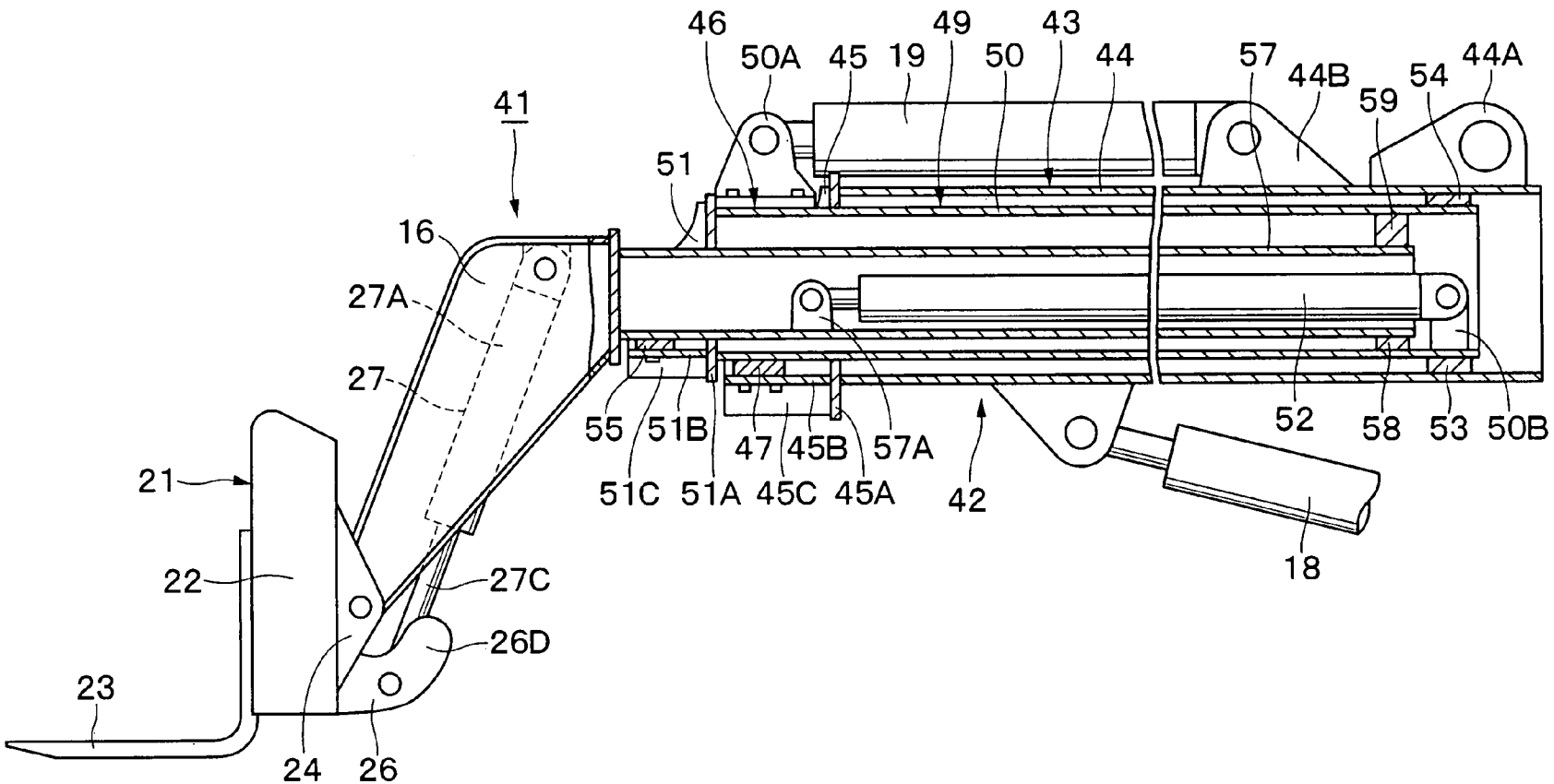
FIG. 9 is a vertical sectional view of the working mechanism in the third embodiment of the invention.

In this instance, as shown in FIG. 9, boom joint portion 44A for connection to the vehicle body 2 as well as cylinder mounting portion 44B are projected from the top side of a base end portion (a rear end portion) of the square tubular body 44. The boom joint portion 44A are pivotally connected to the vehicle body 2 through a pin 17. Supported on the cylinder mounting portion 44B is a bottom side of a first step boom cylinder 19 which stretches or retracts the second step boom cylinder relative to the first step boom 43.

Figure 10:
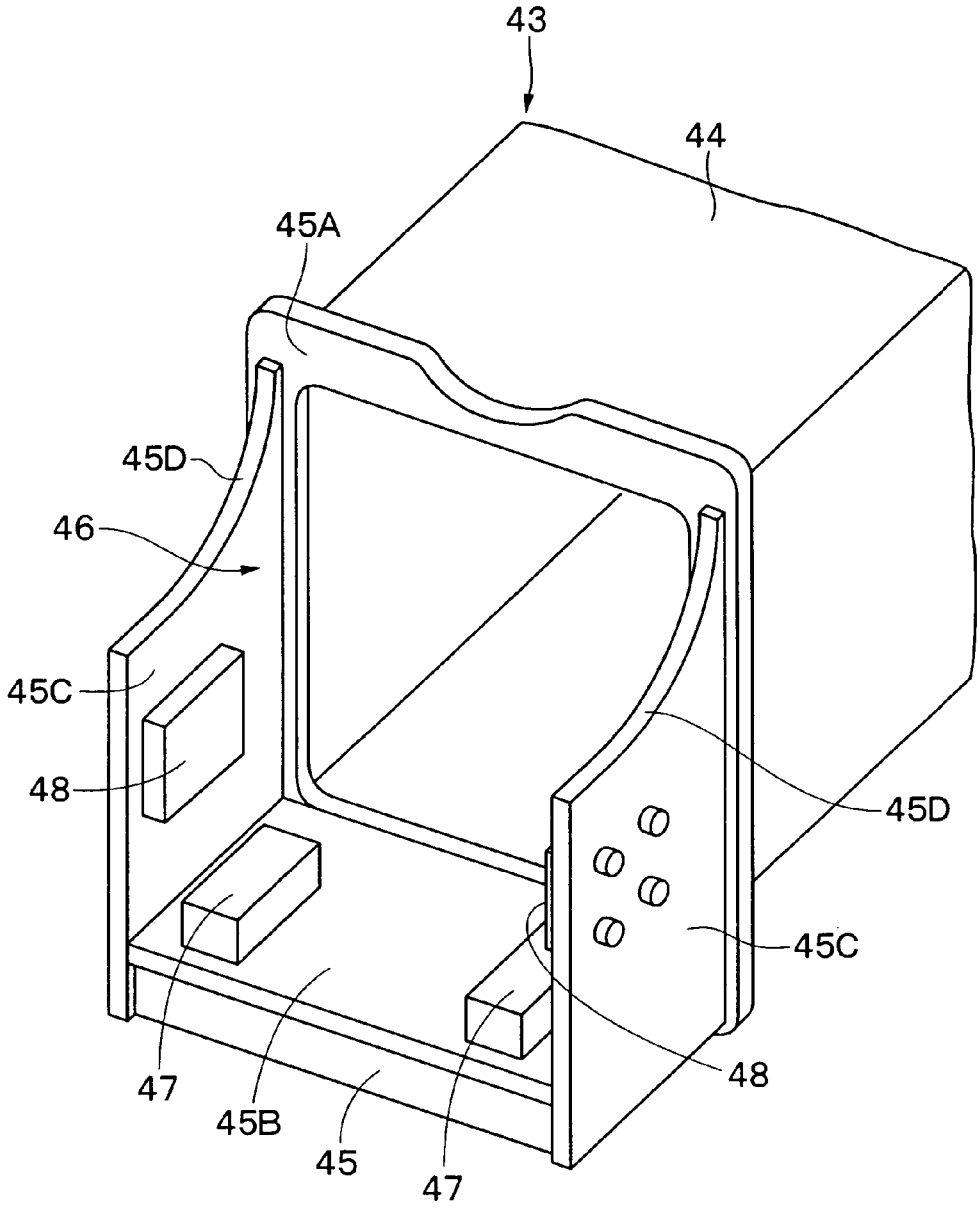
FIG. 10 is a perspective view of a fore end side of a first step boom member.

On the other hand, as shown in FIG. 10, the frame body 45 is constituted by a square flange plate 45A which is securely fixed to the fore end of the square tubular body 44, for example, by welding, a bottom plate 45B which is securely fixed to the flange plate 45A substantially flush with bottom surface of the square tubular body 44, and right and left side plates 45C which are located transversely face to face at the opposite sides of the bottom plate 45B and securely fixed to the bottom plate 45B and the flange plate 45A. The top side between the right and left side plates 45C opens on the upper and lower directions. Upper ends of the right and left side plates 45C are notched downward in the forward direction from the respective rear sides which are fixed to the flange plate 45A, and formed between notched upper ends 45D of the side plates 45C is an opening 46 as described below.

Figure 8:
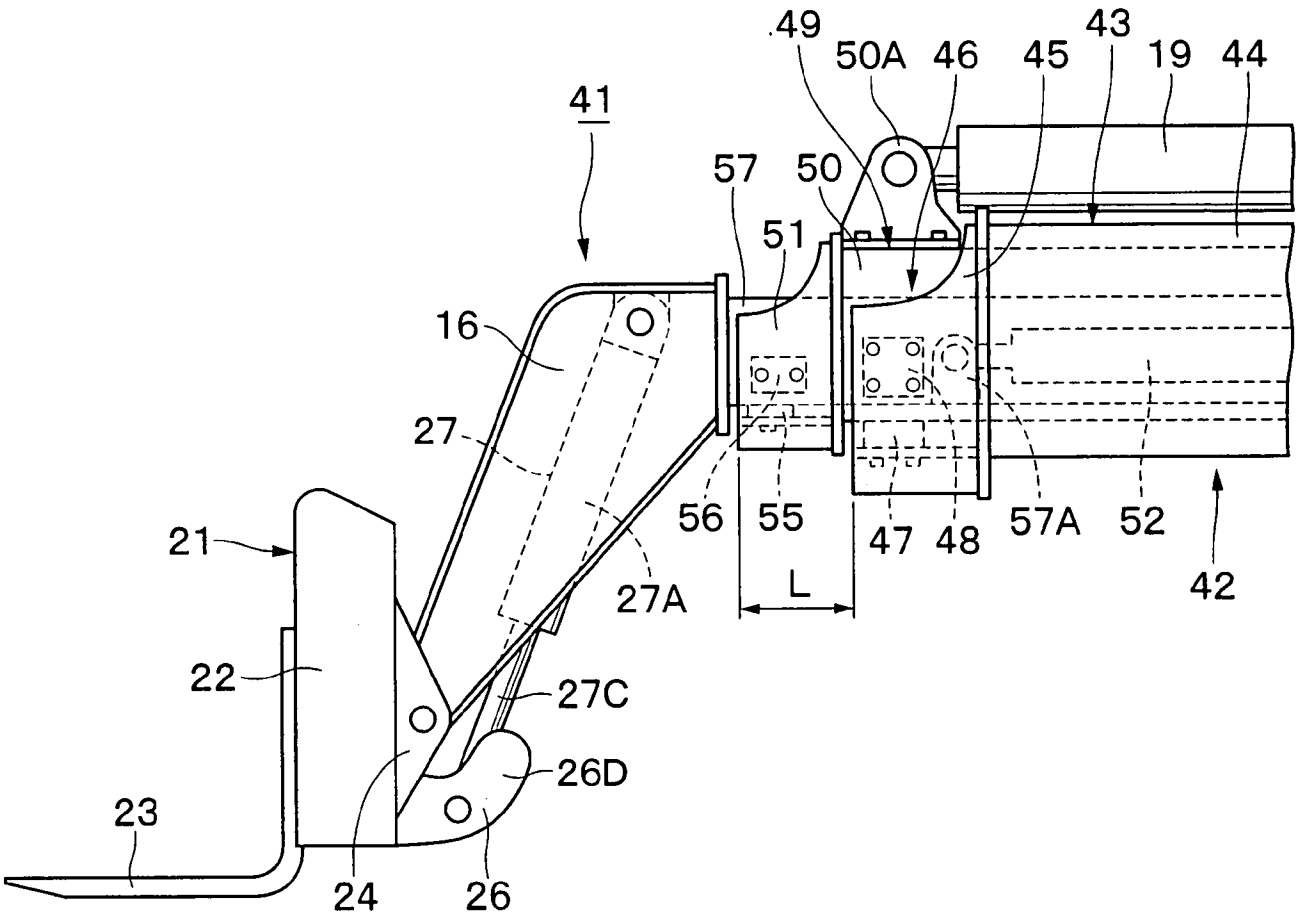
FIG. 8 is a front view of a working mechanism adopted by a third embodiment of the present invention, showing the working mechanism in relation with the boom which is in a contracted state.

Indicated at 46 is the above-mentioned opening which is provided at the fore end of the first step boom 43. More specifically, the opening 46 is an open space which is defined between the notched upper ends 45D of the right and left side plates 45C of the frame body 45, which is open on the upper side. The opening 46 is open on the upward direction and provided in a corresponding position relative to a cylinder mounting portion 50 of the second step boom 49, which will be described hereinafter. As a result, when the second step boom 49 is contracted into the first step boom 43 as shown in FIG. 8, the cylinder mounting portion 50A of the second step boom 49 is accommodated in the opening 46 in a retracted position which is retreated rearward of the fore end of the first step boom 43 (of the frame body 45) toward the base end (toward the square tubular body 44).

Indicated at 47 are lower slide pads which are attached on the bottom plate 45B of the frame body 45 for sliding contact with the lower side of the second step boom 49 which is accommodated in the first step boom 43. Designated at 48 are side slide pads which are attached on the right and left side plates 45C of the frame body 45 for sliding contact with right and left side surfaces of the second step boom 49, respectively.

Indicated at 49 is the above-mentioned second step boom as the inner boom which is telescopically received in the first step boom 43. As shown in FIG. 9, this second step boom 49 is constituted by a square tubular body 50 which is square in sectional shape and extended toward fore and rear ends of the vehicle and adapted to accommodate the third step boom 57 therein, and a frame body 51 which is securely fixed to the fore end of the square tubular body 50.

In this instance, cylinder mounting portion 50A are provided on the upper side of a fore end portion of the square tubular body 50 to support thereon the rod side of the first step boom cylinder 19. As shown in FIGS. 8 and 9, when the second step boom 49 is contracted into the first step boom 43, the cylinder mounting portion 50A is accommodated in the opening 46 in the frame body 45 of the first step boom 43. Further, cylinder mounting portion 50B are provided in the base end side of the square tubular body 50 to support the bottom side of the second step boom cylinder 52, which expands or contracts the third step boom 57 relative to the second step boom 49.

On the other hand, as shown in FIG. 9, the frame body 51 is constituted by a flange plate 51A in the form of a square frame which is securely fixed to the fore end of the square tubular body 50 by welding or other suitable means, a bottom plate 51B securely fixed to the flange plate 51A substantially flush with the bottom surface of the square tubular body 50, and right and left side plates 51C (of which only the right side plate is shown in the drawings) which are securely fixed to the bottom plate 51B and the flange plate 51A and faced toward each other across the bottom plate 51B.

In this instance, lower and upper slide pads 53 and 54 are attached on the lower side and upper side of a base end portion of the square tubular body 50, respectively, for sliding engagement with inner surface of the square tubular body 44 of the first step boom 43.

Further, lower slide pads 55 are attached on the bottom plate 51B of the frame body 51. These lower slide pads 55 are brought into sliding contact with the lower side of the third step boom 57 when the latter is accommodated into the second step boom 49. Furthermore, side slide pads 56 are attached on the side plates 51C of the frame body 51 for sliding engagement with right and left lateral sides of the third step boom 57.

Denoted at 57 is the above-mentioned third step boom which is telescopically received in the second step boom 49. This third step boom 57 is constituted by a square tubular member which is square in sectional shape and extended forward and rearward of the vehicle body. Cylinder mounting portion 57A are provided internally of the third step boom 57 to support the rod side of the second step boom cylinder 52. The boom head 16 is securely fixed to the fore end of the third step boom 57, and the cargo handling tool 21 is pivotally supported at the fore end of the boom head 16.

In this instance, lower and upper slide pads 58 and 59 are attached on the lower and upper sides of a base end portion of the third step boom 57, respectively, for sliding engagement with inner surfaces of the square tubular body 50 of the second step boom 49.

The lift truck according to the third embodiment of the present invention is provided with the working mechanism 41 which is arranged in the manner as described above, having the protective projections 26D provided on the cylinder mounting brackets 26 of the cargo handling tool 21 for protection of the rod 27C of the fork cylinder 27 from obstacles of the ground. In this regard, there is no difference in particular from the working mechanism 11 of the first embodiment.

However, in the case of the working mechanism 41 according to the third embodiment, the opening 46 which opens on the upper side is provided on the frame body 45 at the fore end of the first step boom 43, at a corresponding position relative to the cylinder mounting portion 50A which is provided on a fore end portion of the second step boom 49. Consequently, when the second step boom 49 is contracted into the first step boom 43 as shown in FIG. 8, the cylinder mounting portion 50A can be accommodated in the opening 46 of the frame body 45, that is to say, in a retracted position which is receded toward the base end of the first step boom 43 (toward the square tubular body 44).

As a result, the second step boom 49 can be contracted more deeply into the first step boom 43 to minimize the distance L between the fore ends of the first step and second step booms 43 and 49. This means that, when the second step boom 49 is fully contracted, the entire boom 42 can be folded into a smaller length to ensure safer travels of the lift truck.

Figure 11:
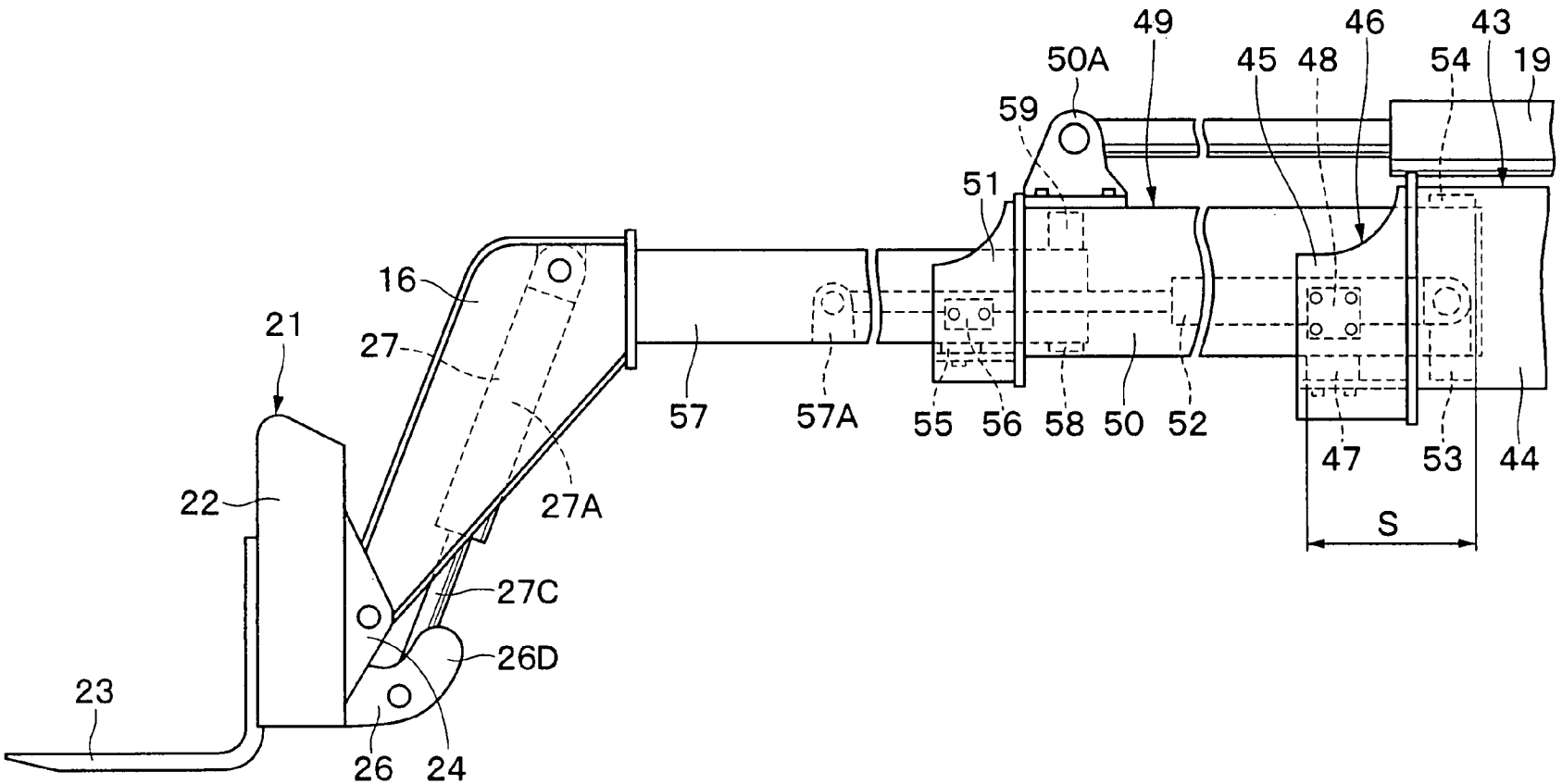
FIG. 11 is a front view of the working mechanism of the third embodiment of the invention, showing the working mechanism in relation with the boom which is in an extended state.

On the other hand, according to the third embodiment of the invention, the lower slide pads 47 are provided on the bottom plate 45B of the frame body 45 of the first step boom 43 for sliding contact with the lower side of the second step boom 49. Therefore, when the second step boom 49 is extended out of the first step boom 43 as shown in FIG. 11, a wider spacing S can be secured between the lower slide pads 47 and the upper slide pads 54 which are provided on the top side of a base end portion of the second step boom.

Figure 12:
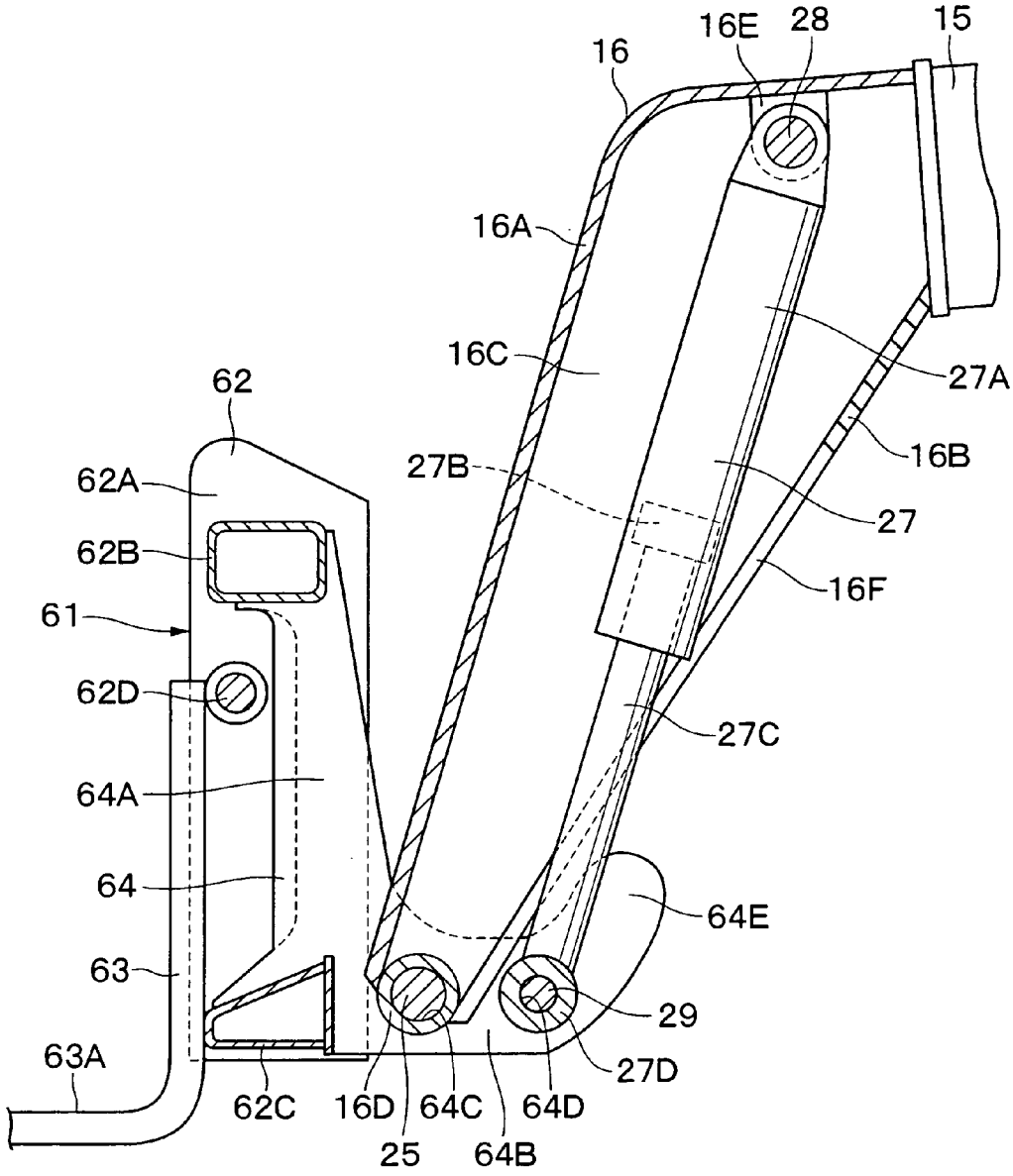
FIG. 12 is a vertical sectional view similar to FIG. 5 but showing the boom head, cargo handling tool, fork cylinder and protective projection according to a fourth embodiment of the invention.
Figure 13:
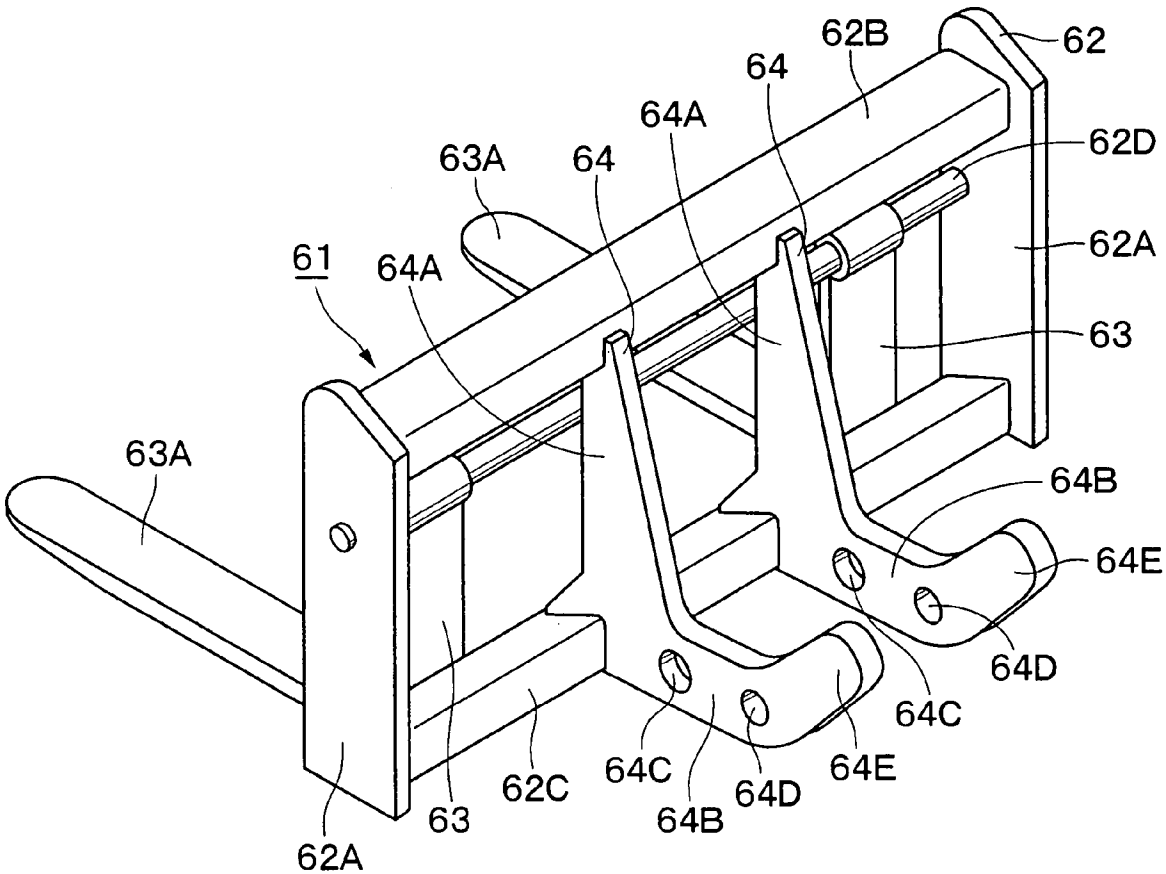
FIG. 13 is a perspective view of the cargo handling tool adopted by the fourth embodiment.

Now, turning to FIGS. 12 and 13, there is shown a fourth embodiment of the present invention. This embodiment has features in that a boom mounting member and a cylinder mounting member are provided as integral parts of mounting plates which are attached to the back side of a working tool, and protective projections which are provided on the mounting plates. In the following description of the fourth embodiment, those component parts which are identical with the counterparts in the foregoing first embodiment are simply designated by the same reference numerals or characters to avoid repetitions of same explanations.

In the drawings, indicated at 61 is a cargo handling tool which is adopted in the present embodiment in place of the cargo handling tool 21 in the first embodiment. This cargo handling tool 61 is pivotally supported at the fore end of the boom 12 (boom head 16) for upward and downward turning movements. The cargo handling tool 61 is constituted by a frame body 62, fork 63 and mounting plates 64.

Indicated at 62 is a rectangular frame body providing a base for the cargo handling tool 61. This frame body 62 is largely constituted by right and left side plates 62A, an upper beam 62B, a lower beam 62C, and an intermediate beam 62D.

Denoted at 63 are L-shaped forks which are attached to the front side of the frame body 62. More specifically, these forks 63 are securely fixed to the intermediate beam 62D of the frame body 62 at the respective upper ends, and lower end portions of the forks 63 are projected forward from the lower beam 62C to provide cargo loading surfaces 63A.

Designated at 64 are right and left mounting plates which are provided on the back side of the frame body 62. Each one of these mounting plates 64 is formed in such a way as to integrate a boom mounting member and a cylinder mounting member into one structure, and thus has functions of a boom mounting member and functions of a cylinder mounting member as well. In this instance, each mounting plate 64 is formed substantially in the shape of letter "J" by the use of a thick steel plate material, and provided with a vertical plate section 64A which is securely fixed to the upper beam 62B and the lower beam 62C at its upper and lower ends, respectively, and a foot portion 64B which is projected substantially horizontally from the lower end of the vertical plate portion 64A toward the vehicle body.

A pin receiving hole 64C is provided in the base end side of the foot portion 64B for connection to the boom. In addition, for connection to a cylinder, another pin receiving hole 64D is provided in a fore end side of the foot portion 64B (on the side of the vehicle body). Further, integrally formed at a toe portion of the foot portion 64B is a protective projection 64E which will be described in greater detail hereinafter.

In this instance, the pin receiving holes 64C and 64D are bored side by side in the horizontal direction. That is to say, when the cargo loading surfaces 63A of the forks 63 are in a horizontal state relative to the ground surface, the centers of the pin receiving holes 64C and 64D are at the same height from the ground surface.

After placing the foot portion 64B of the two mounting plates 64 to grip the boss portion 16D of the boom head 16 from opposite sides, the pin 25 is inserted in the boss portion 16D and the pin receiving holes 64C in the two mounting plates 64. Whereupon, the cargo handling tool 61 is attached to the fore end of the boom head 16 pivotally for upward and downward turning movements about the pin 25. Upon inserting the pin 29 into the pin receiving holes 64D in the mounting plates 64 and the boss portion 27D, the rod 27C of the fork cylinder 27 is pivotally connected to the cargo handling tool 61 for turning movements about the pin 29.

Indicated at 64E are protective projections which are provided on the right and left mounting plates 64. Each one of the protective projections 64E is integrally formed at the toe end of the foot portion 64B of each mounting plate 64 immediately on the outer side of the pin receiving hole 64D. In this instance, the two protective projections 64E which are positioned on the opposite sides of a fore end portion of the fork cylinder rod 27C are bent obliquely upward to the fork cylinder 27 and are projected toward the vehicle body to protect the rod 27C of the fork cylinder 27 from obstacles on the ground.

With the cargo handling tool 61 which is arranged as described above, the lift truck according to the fourth embodiment has no differences from the foregoing first embodiment in fundamental performance.

However, in the case of the fourth embodiment, right and left mounting plates 64 which are attached to the back side of the frame body 62 of the cargo handling tool 61 are of a complex form, each integrally containing a boom mounting member and a cylinder mounting member. As a consequence, the cargo handling tool 61 can be simplified in construction as compared with the cargo handling tool which has boom mounting members and cylinder mounting members separately attached to the back side of the frame body 62.

Figure 14:
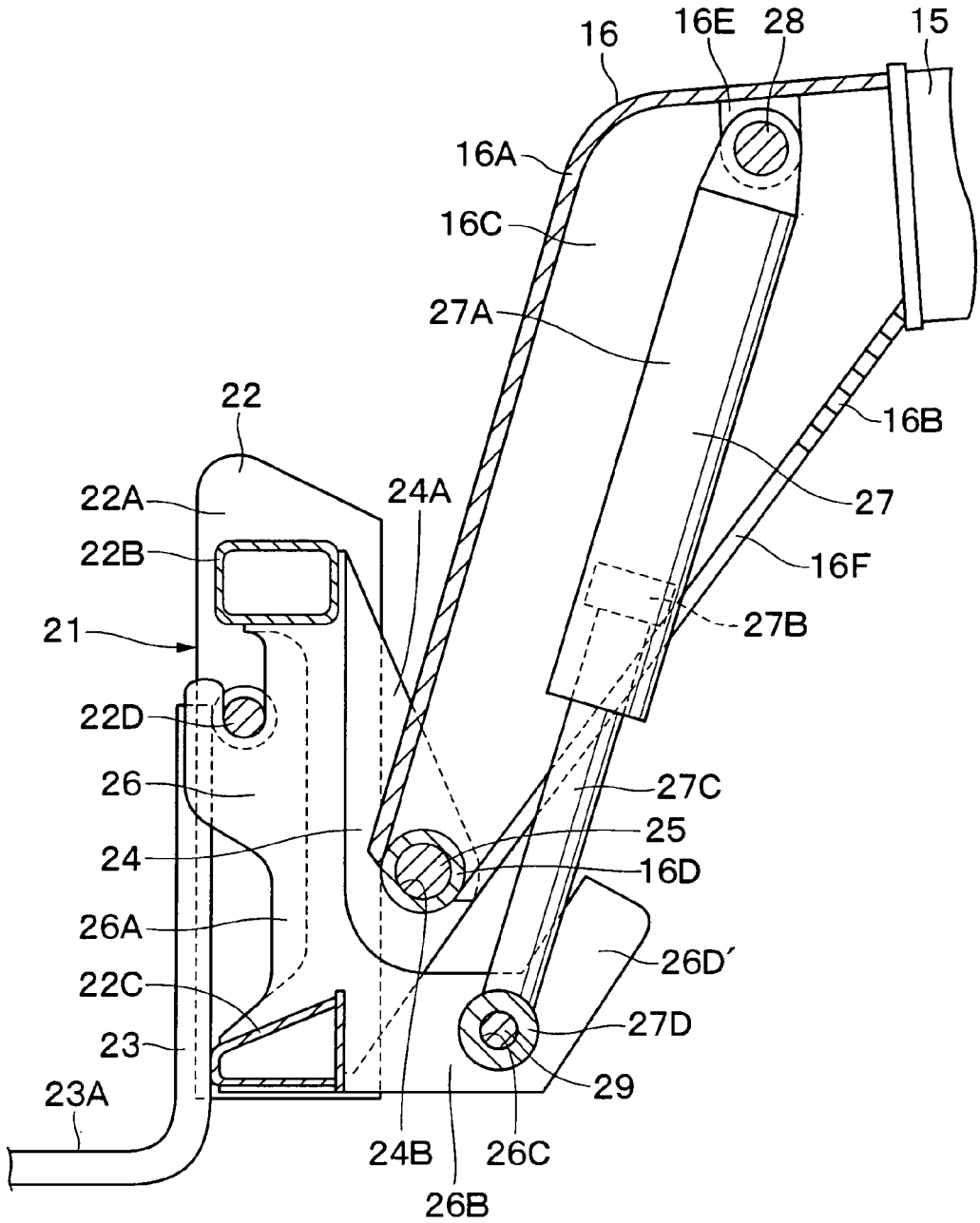
FIG. 14 is a vertical sectional view similar to FIG. 5 but showing a modification of the protective projection.

In the above-described first embodiment, the protective projections 26D which are provided on the cylinder mounting brackets 26 are exemplified as arcuate projections which are bent toward the fork cylinder 27 arcuately about the pin 25, which connects the boom mounting plates 24 of the cargo handling tool 21 with the boom head 16. However, it is to be understood that the present invention is not limited to the particular form shown. For example, as in a modification shown in FIG. 14, there may be employed protective projections 26D' which are arranged to project rectilinearly in an obliquely upward direction toward the fork cylinder 27 from the pin receiving holes 26C to the cylinder mounting brackets 26.

Further, in the above-described first embodiment, one fork cylinder 27 is provided between the cargo handling tool 21 and the boom 12, and the rod 27C of the fork cylinder 27 is protected by the protective projections 26D which are provided on the cylinder mounting brackets 26 of the cargo handling tool 21. However, in this regard, the present invention is not limited to the particular arrangements shown. For example, in a case where a plural number of fork cylinders are provided between the boom 12 and a cargo handling tool 21, the protective projections can be provided for each one of the rod of the fork cylinders in a similar manner. The same applies to the second embodiment.

Furthermore, in each one of the foregoing embodiments of the invention, by way of example the bottom side of the tube 27A of the fork cylinder 27 is mounted on the brackets 16E on the part of the boom head 16, while the rod 27C (the boss portion 27D) of the fork cylinder 27 is supported on the cylinder mounting brackets 26 on the part of the cargo handling tool 21, protecting the rod 27C by the protective projections 26D which are provided on the cylinder mounting brackets 26. However, the present invention is not limited to the particular examples shown. For instance, it is also possible to support the rod 27C of the fork cylinder 27 by the brackets 16E on the part of the boom head 16, while supporting the bottom side of the tube 27A by the cylinder mounting brackets 26 on the part of the cargo handling tool 21. In this case, the tube 27A is protected by the protective projections 26D on the cylinder mounting brackets 26 from possibilities of deformations and damages which might otherwise occur to the tube 27A as a result of collision against obstacles.

Moreover, in the foregoing first and second embodiments, the boom 12 is exemplified as the three stepstyle booms which are constituted by the first step boom 13, the second step boom 14 and third step boom 15. Needless to say, the present invention is not limited to booms of that type, and can be similarly applied to single step type booms or other multi-step type booms operating in two steps or more than four steps.

Furthermore, in each one of the foregoing embodiments, by way of example the present invention has been described in connection with a lift truck which is equipped with the cargo handling tool 21 (31) for lifting and transferring freight goods. However, the present invention is not limited to the lift trucks of the type shown but can be widely applied to other automotive working machines, for example, to wheel loaders which are equipped with a loader bucket as a working tool.

The invention claimed is:

1. An automotive working machine having an automotive vehicle body provided on left and right front wheels and left and right rear wheels, a boom liftably mounted on said vehicle body, a working tool rotatably supported on a fore end portion of said boom, and a tool operating cylinder located between said boom and said working tool at one and the other axial end thereof to turn said working tool in upward and downward directions relative to said boom, characterized in that said automotive working machine comprises:

a boom mounting member provided on the back side of said working tool, on the side of said vehicle body, and having a boom connecting portion pivotally connected to said fore end portion of said boom, along with a cylinder mounting member having a cylinder connecting portion pivotally connected to the other end of said tool operating cylinder; and protective projections provided on said cylinder mounting member and projected from the back side of said working tool toward said vehicle body to protect said other end of said tool operating cylinder from obstacles on a ground surface when said vehicle body is put in travel with said boom in a folded position on the side of the ground;

wherein said protective projections are bent in an obliquely upward direction from a cylinder connecting portion of said cylinder mounting member toward said tool operating cylinder.

2. An automotive working machine as defined in claim 1, wherein said protective projections are each in the form of an arcuate projection extending toward said tool operating cylinder and bent arcuately about a boom connecting portion of said boom mounting member at the back of said working tool.

3. An automotive working machine as defined in claim 1, wherein said protective projections are formed separately from said cylinder mounting member and detachably attached to said cylinder mounting member.

4. An automotive working machine as defined in claim 1, wherein said protective projections are constituted by a pair of right and left plate-like members adapted to grip the other end of said tool operating cylinder therebetween.

5. An automotive working machine as defined in claim 1, wherein said tool operating cylinder is constituted by a tube having one axial end thereof connected to said boom, a piston slidably fitted in said tube, and a rod having one axial end thereof connected to said piston and projected out of said tube at the other axial end to connect to the cylinder connecting portion of said cylinder mounting member;

said protective projections being adapted to protect the other projected end of said rod.

6. An automotive working machine as defined in claim 1, wherein said boom is provided with an outer boom of hollow tubular shape being liftably connected to said vehicle body at a base end portion, and an inner boom being extensibly fitted in said outer boom and provided with a cylinder mounting portion on a fore end portion thereof;

a boom cylinder being located outside of said outer boom and having a base end portion thereof attached to said outer boom and a fore end portion supported on said cylinder mounting portion on said inner boom; and said outer boom being provided with an opening in a fore end portion to accommodate said cylinder mounting portion in a retracted position inward of a fore end of said outer boom when said inner boom is retracted into said outer boom.

7. An automotive working machine as defined in claim 6, wherein said outer boom is composed of a tubular body for accommodating said inner boom, and a box-like frame body securely attached to a fore end of said tubular body, said frame body defining therein said opening in a corresponding position relative to said cylinder mounting portion of said inner boom.

* * * * *